United States Patent [19]

Kudo et al.

[11] Patent Number: 4,581,202

[45] Date of Patent: Apr. 8, 1986

[54] SINTERED STAINLESS STEEL AND PRODUCTION PROCESS THEREFOR

[75] Inventors: Takeo Kudo; Yoshio Tarutani, both of Nishinomiya, Japan

[73] Assignee: Sumitomo Metal Industries, Ltd., Osaka, Japan

[21] Appl. No.: 710,086

[22] Filed: Mar. 11, 1985

[30] Foreign Application Priority Data

Mar. 12, 1984 [JP] Japan ..... 59-045486

[51] Int. Cl.[4] ..... B22F 1/00

[52] U.S. Cl. ..... 419/42; 419/49; 419/68; 148/38; 148/136; 75/128 W; 75/246

[58] Field of Search ..... 419/42, 38, 49, 68; 148/38, 136; 75/128 W, 246

[56] References Cited

U.S. PATENT DOCUMENTS 3,859,086 1/1975 Church et al. ..... 419/31
3,940,269 2/1976 Bergstrom ..... 419/41
4,435,483 3/1984 Anslund ..... 419/2

*Primary Examiner*—Stephen J. Lechert, Jr.
*Attorney, Agent, or Firm*—Burns, Doane, Swecker & Mathis

[57] ABSTRACT

A sintered stainless steel and sintered seamless steel pipe exhibiting improved resistance to stress corrosion cracking are disclosed. The metallurgical structure comprises a matrix phase and a dispersing phase, which are different from each other in their metallurgical structures, the matrix phase comprising a substantially single ferritic structure, and the dispersing phase comprising a structure selected from the group consisting of an austenitic structure, an austenitic+ferritic dual phase structure, an austenitic+martensitic dual phase structure, and an austenitic+ferritic+martensitic triple phase structure. The sintered seamless stainless steel pipes are useful as heat exchanging tubes and piping to which sea water or industrial water is fed.

24 Claims, 9 Drawing Figures

SINTERED STAINLESS STEEL AND PRODUCTION PROCESS THEREFOR

BACKGROUND OF THE INVENTION

The present invention relates to a sintered stainless steel exhibiting markedly improved resistance to stress corrosion cracking and the production thereof, the steel comprising a matrix phase of a substantially ferritic structure and a dispersing phase containing an austenitic area. The dispersing phase is selected from the group consisting of a single austenitic structure, an austenitic+ferritic structure, an austenitic+martensitic structure, and an austenitic+ferritic+martensitic structure.

As is well known in the art, stainless steel is classified into martensitic, ferritic, austenitic, and duplex types.

Ferritic stainless steel is not expensive and it exhibits good resistance to stress corrosion cracking. However, it has poor toughness and its weldability is not good.

Austenitic stainless steel exhibits good toughness as well as extremely high resistance to corrosion under usual conditions. However, in general, it is expensive since it contains a relatively large amount of Ni and it does not exhibit good resistance to stress corrosion cracking ("SCC"hereunder). The incorporation of a relatively large amount of Ni is effective for improving the resistance to SCC to some extent, but the effect derived from the addition of nickel saturates at a certain level. Furthermore, the addition of nickel makes the steel expensive, resulting in limited applications therefor.

Duplex stainless steel has been proposed so as to eliminate the above-mentioned shortcomings, and it has not only the advantages which the ferritic stainless steels have but also those of the austenitic stainless steels. Duplex steel also exhibits the same level of toughness as austenitic stainless steel does and much better SCC resistance.

Regarding the SCC resistance of duplex stainless steel, an article by Edeleanu appeared in the Journal Iron Steel Inst., 173, 140 (1953) describing the influence of the amount of δ-ferritic phase in 18Cr-8Ni-Ti steels on SCC resistance. Since then, a number of other articles have been published. It has been reported that alloying elements, heat treatment conditions, and the amount of ferritic phase have an influence on SCC resistance.

As is well known in the art, duplex stainless steel is characterized by a high ultimate stress against SCC. FIG. 1 and FIG. 2 are graphs disclosed in the Journal of Corrosion Engineering, Vol. 30, No. 4, pp. 218–226 (1981) by one of the inventors of the present invention. FIG. 1 shows the SCC resistance in a 427K, 45% $MgCl_2$ solution for 25Cr stainless steel test samples of which the nickel content was varied. The test samples were dipped in a boiling solution for 2000 hours. The ordinate is a stress ratio, i.e., the ratio of the ultimate stress against the SCC resistance to the 0.2% yielding point ($\sigma_{th}/\sigma_{0.2}$). The higher the ratio, the better is the SCC resistance. Cracking does not occur for Ni-free ferritic stainless steel, but the ratio of $\sigma_{th}/\sigma_{0.2}$ rapidly decreases for a ferritic stainless steel which contains a very small amount of Ni. The ratio $\sigma_{th}/\sigma_{0.2}$ reaches a minimum when the nickel content is 2%. For 6–8% Ni steels, the value of $\sigma_{th}/\sigma_{0.2}$ increases for the reason that the structure comprises a duplex of a ferritic structure and an austenitic one. However, the SCC resistance of the duplex stainless steel is still inferior to a Ni-free ferritic stainless steel. It is thought that this is because the ferritic phase of the duplex stainless steel contains a relatively large amount of Ni due to redistribution between ferritic phase and austenitic phase.

FIG. 2 shows graphs of the SCC resistance determined for 25Cr–6Ni duplex stainless steel (designated by the symbol "0"), 28Cr-4Ni ferritic stainless steel, the composition of which corresponds to that of the ferritic phase of the duplex steel (designated by the symbol "●"), and 21Cr-9Ni austenitic stainless steel, the composition of which corresponds to that of the austenitic phase of the duplex steel (designated by the symbol "Δ". The corrosion tests were carried out under the same conditions as those used in the case of FIG. 1. Graph (a) shows the relationship between the applied stress and the time to failure. Graph (b) shows the stress ratio ($\sigma_{th}/\sigma_{0.2}$) plotted against the time to failure.

A 28Cr-4Ni ferritic stainless steel, though it is designated as ferritic one, exhibits less SCC resistance since it contains 4% of Ni. It is supposed that this is the reason why SCC propagates through a ferritic phase, detours an isolated austenitic phase, and stops open reaching another austenitic phase in conventional duplex stainless steels.

FIG. 3 schematically illustrates the above-described mechanism of SCC propagation in a conventional duplex stainless steel, which was prepared using an ingot making process. In this figure, the thick line indicates the path along which the SCC propagates. It is apparent that the SCC resistance of a duplex stainless steel is determined by that of the ferritic phase contained therein. Such a ferritic phase unavoidably contains about 4% of nickel due to redistribution between the ferritic phase and the austenitic phase during solidification. Therefore, duplex stainless steel exhibits SCC resistance inferior to that of Ni-free ferritic stainless steel.

Conventional duplex stainless steel must contain 4–8% by weight of nickel so as to make a dual phase, and even the ferritic phase thereof contains 3–6% by weight of nickel due to redistribution between the ferritic phase and the austenitic phase. Therefore, the resulting steel exhibits less SCC resistance than does Ni-free ferritic stainless steel.

It is desirable to provide less expensive pipes for use in the construction of heat-exchanging tubes and piping to which sea-water or industrial water is fed. Since heat exchanging tubes are frequently used under extremely severe conditions, they must exhibit high resistance to SCC. For this purpose, a variety of steel alloys have been proposed, and these are shaped into seamless steel pipes. As is well known in the art, stainless steel has been widely used to make seamless boiler tubes or piping due to its good resistance to corrosion as well as good mechanical properties.

It has been known in the art that a powder metallurgical process can be applied to provide a sintered seamless pipe. However, it has not yet been known in the art to mix different types of stainless steel powder in order to improve corrosion resistance, especially the resistance to SCC. Shodoshima et al. described the high temperature behavior of a sintered product of mixed powders of AISI 430L type powder and AISI 304L type powder ("TETSU-TO-HAGANE", Vol. 76, No. 13, 1981, S1160), stating that the sintered product after cold rolling has a density which is 96.4% of that of the product manufactured through an ingot making process. They also state that the tensile strength and elongation at high temperatures (700°–900° C., for example) are on the average the same as those of a sintered product of one type of powder, i.e. a mono-powder. However, they made no suggestions as to synergistic effects on improvement in chemical or physical properties, especially on improvement in the resistance to SCC, which is achieved by preventing the diffusion of Ni from an austenitic stainless steel powder and/or dual phase stainless steel powder and/or triple phase stainless steel powder to a ferritic stainless steel powder during sintering.

SUMMARY OF THE INVENTION

The primary object of the present invention is to provide a stainless steel which exhibits better SCC resistance than conventional duplex stainless steel.

The secondary object of the present invention is to provide a stainless steel exhibiting toughness as high as that of austenitic stainless steel and SCC resistance as good as that of ferritic stainless steel.

Another object of the present invention is to provide a method for producing a sintered stainless steel which exhibits not only markedly improved SCC resistance but also a satisfactory level of toughness.

Still another object of the present invention is to provide a sintered seamless stainless steel pipe, especially a sintered seamless stainless steel pipe which can be advantageously used under highly corrosive conditions as heat exchanging tubes and piping to which sea water or industrial water is fed.

Figure 1:
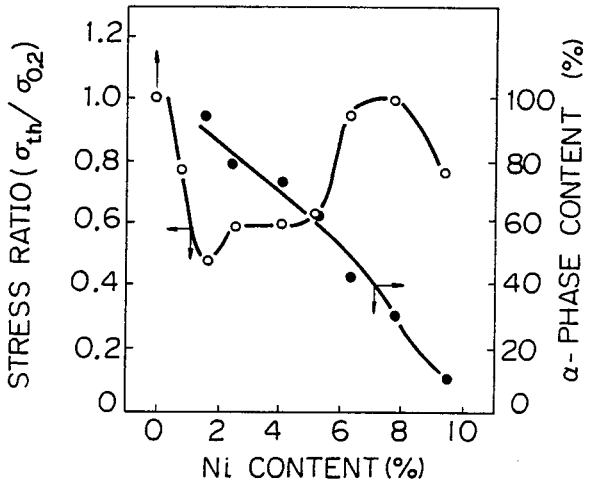
FIG. 1 and FIG. 2 are graphs showing the SCC resistance test results of conventional stainless steels obtained by way of an ingot making process.
Figure 2:
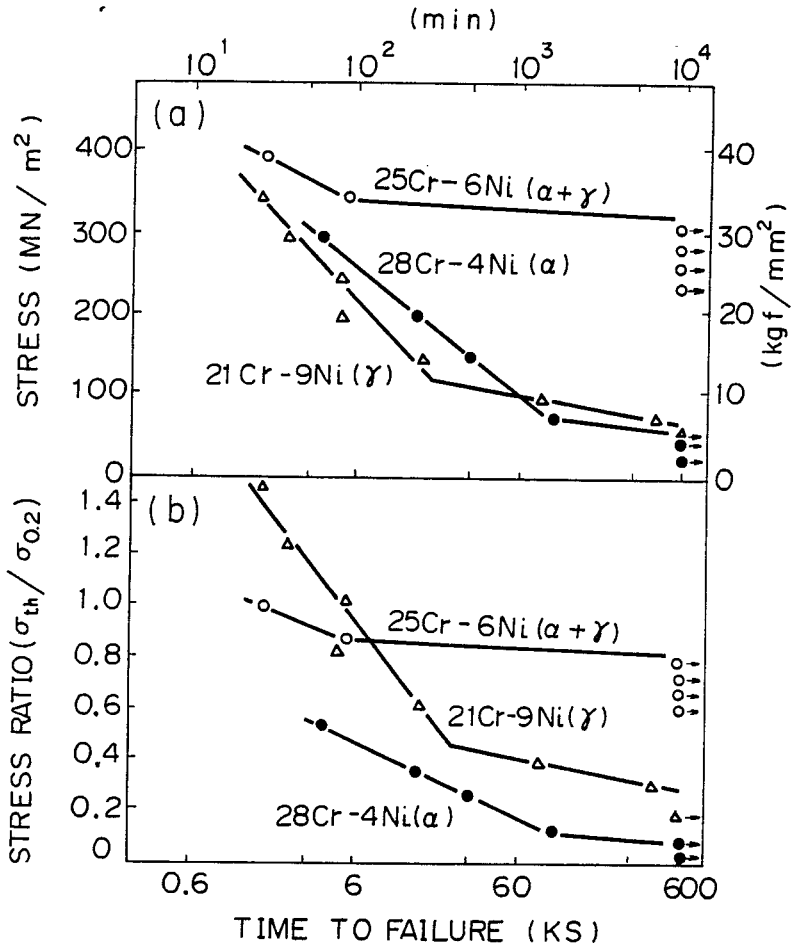
Figure 3:
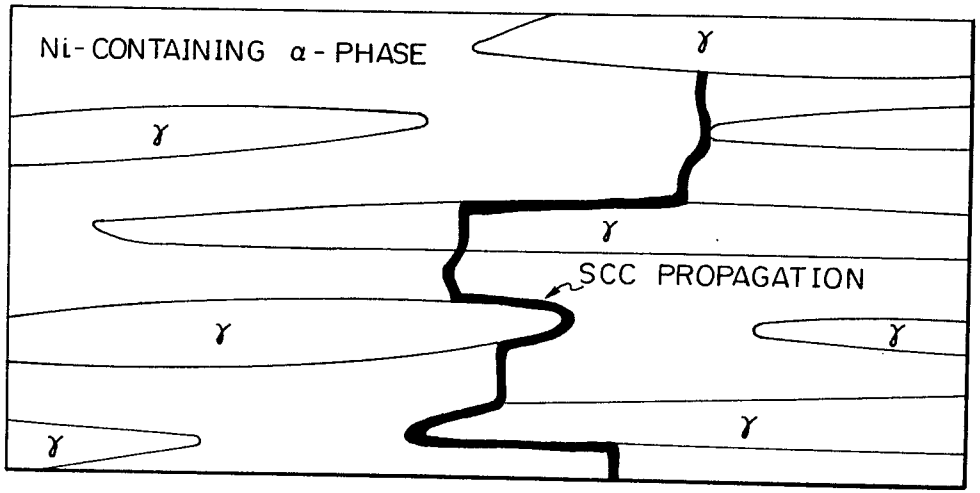
FIG. 3 is a view schematically illustrating the propagation of SCC in the case of a conventional duplex stainless steel produced by way of an ingot making process.

As stated above, it has been thought in the art that it is unavoidable to include a few percent of nickel in a ferritic phase of duplex stainless steel. However, the inventors of the present invention, based on the results shown in FIGS. 1 and 2, found that if the nickel content of the ferritic phase of duplex stainless steel is reduced to a lower level, the SCC resistance can be improved markedly. The present inventors have carried out a series of experiments to find measures to freely control the nickel content of the ferritic phase of duplex stainless steel. After intensive research, the inventors have found that the above-described prior art problem can be easily overcome by employing a powder metallurgy process in which steel powders with alloying compositions corresponding to each of the constitutional phases, i.e., a ferritic phase and austenitic phase, are prepared separately through an atomization process. The thus prepared steel powders are mixed at a given ratio to provide a green compact which is then sintered to give a sintered product in the shape of a pipe, plate, or the like.

Therefore, the present invention resides in a sintered stainless steel exhibiting improved resistance to stress corrosion cracking, which comprises a matrix phase and a dispersing phase, the metallurgical structures of which are different from each other, the matrix phase comprising a substantially single ferritic structure derived from a ferritic stainless steel powder, and the dispersing phase comprising a structure selected from the group consisting of an austenitic structure, an austenitic+ferritic dual phase structure, an austenitic+martensitic dual phase structure, and an austenitic+ferritic+martensitic triple phase structure, which are derived respectively from an austenitic stainless steel powder, an austenitic+ferritic duplex stainless steel powder, an austenitic+martensitic duplex stainless steel powder and a triple phase stainless steel powder.

In another aspect, the present invention resides in a process for producing a sintered stainless steel exhibiting improved resistance to stress corrosion cracking, which comprises a matrix phase and a dispersing phase, the metallurgical structures of which are different from each other, comprising the steps of mixing a ferritic stainless steel powder with a powder selected from the group consisting of an austenitic stainless steel powder, an austenitic+ferritic duplex stainless steel powder, an austenitic+martensitic duplex stainless steel powder, and an austenitic+ferritic+martensitic triple phase stainless steel powder, and compacting and sintering the resulting powder mixture.

According to still another aspect, the compacting and sintering can be carried out simultaneously using a hot isostatic pressing process. Alternatively, only the compacting may be carried out through a cold isostatic pressing process.

In case a sintered seamless stainless steel pipe is produced, the resulting powder mixture is subjected to compacting and sintering, and preferably cold isostatic pressing and then sintering, or hot isostatic pressing. The resulting sintered stainless steel is formed into a seamless pipe through hot extruding. Cold drawing is applied to the hot extruded product. Cold drawing is applied to the hot extruded seamless pipe of sintered stainless steel to provide a sintered seamless pipe with final dimensions.

The thus produced seamless pipe is especially advantageous for use as heat exchanging tubes and piping through which sea water or industrial water is fed.

The ferritic stainless steel to which the present invention is applicable and which serves as a matrix phase includes AISI 410, 430, 434, 444, XM27, and the like.

The austenitic stainless steel which serves as a dispersing phase includes AISI 304, 304L, 316, 316L, 317, 317L, and so on.

The duplex stainless steel which also serves as a dispersing phase includes AISI 329Jl and the like.

When AISI 410 steel is used as a matrix component, the resulting matrix contains a small amount of martensitic phase dispersed in a ferritic phase. In addition, when AISI 304 steel is used as a dispersing phase, the resulting dispersing phase comprises a combined structure of an austenitic phase and a martensitic phase.

Figure 4:
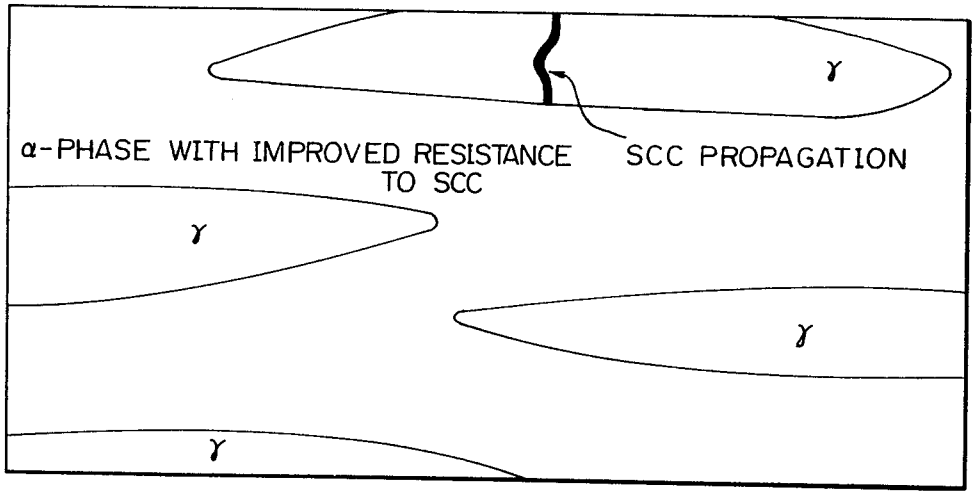
FIG. 4 and FIG. 5 are views schematically illustrating the propagation of SCC in the case of the stainless steel obtained by the process of the present invention.

According to the present invention, since a ferritic phase which exhibits improved SCC resistance is present as a matrix phase, as shown in FIG. 4, for example, the propagation of SCC would be prevented by the ferritic phase if the SCC occurred in an austenitic phase which serves as a dispersing phase. This is because the above ferritic phase is far less sensitive to or free from SCC. If SCC is once initiated, the propagation of the SCC is prevented by the above-described ferritic phase. The propagation of SCC is indicated by the bold line in FIG. 4. The same thing can be said for a case in which duplex stainless steel powder or ferritic+austenitic+-martensitic triple phase stainless steel powder is used as a dispersing phase.

Figure 5:
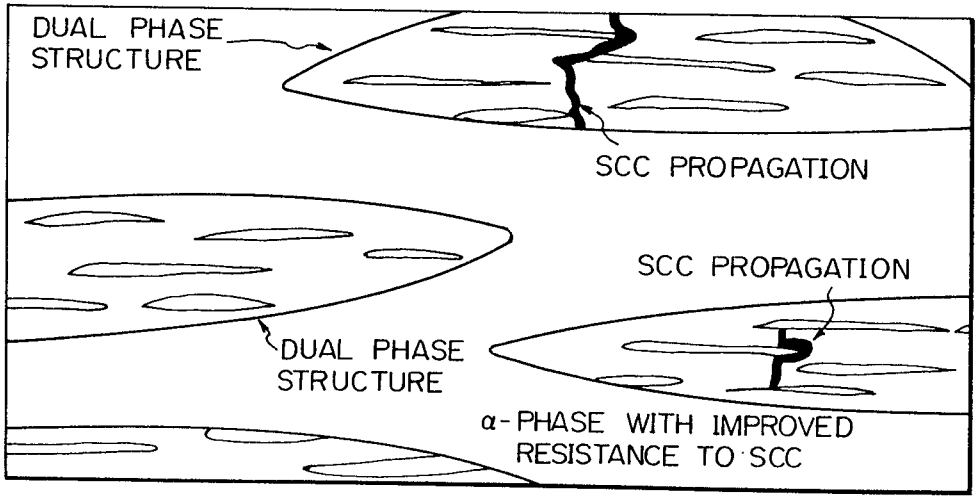

FIG. 5 schematically shows the case in which the dispersing phase comprises a dual phase structure. Since the dispersing phase is comprised of a dual phase structure, the propagation of SCC shown by the real heavy line in FIG. 5 will be prevented even within the dispersing phase of a dual phase structure in the same manner as in the conventional duplex stainless steel. In addition, the propagation of SCC will also be prevented at an interface between the dispersing phase and the matrix phase. Thus, according to an embodiment shown in FIG. 5, the SCC resistance will be markedly improved.

The mechanism by which SCC resistance can be improved in the present invention will be described in more detail.

According to the present invention, a ferritic phase which is derived from ferritic stainless steel powder exists as a matrix phase, i.e., the ferritic phase exists surrounding discrete "islands" of an austenitic phase, ferritic+austenitic duplex, and the like. Therefore, even if SCC occurs, since the matrix is of a ferritic phase exhibiting improved resistance to SCC, the propagation of the SCC will successfully be prevented, and the resulting sintered product, as a whole, will show improved SCC resistance.

In addition, the ferritic phase which constitutes a matrix phase is derived from a melt of ferritic stainless steel and the melt is subjected to atomization, for example, to give ferritic stainless steel powder. Therefore, the nickel content can be varied freely. It is therefore possible to have a nickel content of 1% or less. At such a low nickel content, ferritic stainless steel can exhibit markedly improved resistance to SCC.

Thus, when a ferritic stainless steel powder, the nickel content of which has been adjusted as described above, is mixed with an austenitic stainless steel powder and the resulting mixture is sintered to provide a sintered stainless steel, nickel diffusion progresses to some extent during sintering, but the nickel does not reach the center area of the ferritic grains. The formation of an area rich in nickel is successfully prevented in the ferrite grains. This nickel enrichment was experienced in the prior art due to redistribution during solidification from a melt. In contrast, according to the process of the present invention, the composition and structure of the starting powder can substantially be preserved. This means that it is possible to control the nickel content of the matrix phase of the sintered stainless steel of the present invention by adjusting the nickel content of the starting powders of the matrix phase.

The incorporation of molybdenum in a ferritic stainless steel which constitutes the matrix phase is effective for further improving the corrosion resistance under much more severe corrosive conditions. When molybdenum is added, the molybdenum content is preferably not lower than 0.5%. Alternatively, molybdenum may be incorporated in a dispersing phase, i.e., austenitic stainless steel powder, duplex steel powder or triple phase stainless steel.

The sintered stainless steel of the present invention is prepared through at least one of the following manufacturing steps: compacting, cold isostatic pressing, sintering, hot isostatic pressing, cold extruding, cold drawing, hot extruding, hot drawing, forging, rolling, and the like, although the compacting and sintering steps are indispensable.

The sintered steel may further be subjected to a heat treatment as necessary. In other words, the sintered stainless steel of the present invention may include any one which has been produced through at least one of the above-mentioned working steps.

The matrix of the present invention steel, which is composed of a substantially single ferritic phase may be, needless to say, a single ferritic phase, and it may also be a ferritic phase which contains a slight amount of martensitic phase and other precipitates. The amount of the martensite is at most 10%. In addition, not only inevitable impurities and alloying element usually found in stainless steels but also free-cutting additives such as S, Pb, Se, Te, Ca etc. may also be incorporated in the steel.

It is herein to be noted that the present invention is not limited to any particular manufacturing process, or dimension, or size distribution of the starting powders so long as they do not adversely affect the purpose of the present invention.

Furthermore, according to the present invention, a ferritic stainless steel powder is mixed with any one or more of an austenitic stainless steel powder, a duplex stainless steel powder, and a triple phase stainless steel powder. Any combination may be selected in view of the intended purposes. Preferably, the ferritic phase derived from a ferritic stainless steel powder comprises 20–80% by weight, and more preferably 30–70% by weight so as to provide a continuous phase with much improved resistance to SCC.

Thus, according to an embodiment of the present invention, a sintered stainless steel may be provided which is made up of a metallurgical structure comprising 20–80% by weight of a ferritic phase derived from a ferritic stainless steel powder. In a further restricted embodiment of the present invention, a sintered stainless steel exhibiting improved resistance to SCC is provided which is composed of a metallurgical structure comprising 20–80% by weight of a ferritic phase which comes from a ferritic stainless steel powder substantially free from nickel, with the balance being of a single austenitic phase, a ferritic or martensitic+austenitic dual phase, or a ferritic+martensitic+austenitic triple phase.

As is apparent from the above, the steel of the present invention is quite different from the conventional duplex stainless steel which is prepared through an ingot making process in that the proportion of the two phases may be freely controlled and a variety of steels may be produced, from a less expensive one corresponding to the conventional duplex stainless steel to an expensive one which exhibits better corrosion resistance than the conventional duplex stainless steel. Depending on a particular purpose a suitable composition may be selected and prepared with improved resistance to SCC.

It is generally said that the mechanical properties of a sintered products are compatible with those of the conventional product prepared through an ingot making process. In fact, as shown in the following working example, the mechanical properties of the sintered products of the present invention are compatible with those of the conventional product. Therefore, the sintered stainless steel of the present invention may be used not only as sintered with or without the application of heat treatment, but also in the form of shapes including pipes, plates, and the like with being subjected to working such as rolling, extruding, forging, etc. This is a very important practical advantage.

It is herein to be noted that the thus manufactued seamless pipes are especially useful when used under severe conditions as heat exchanging tubes and piping through which sea water or industrial water is fed.

The present invention will be further described in conjunction with some working examples, which are presented merely for illustrative purposes.

EXAMPLE 1

Six types of stainless steel powder (−300 mesh) the alloy composition of which are shown in Table 1 were prepared through an atomization process. The steel composition of Steel Powders A, B, and C correspond to ferritic stainless steels, Steel Powders D and E correspond to austenitic stainless steels, and Steel Powder F corresponds to a duplex stainless steel.

These powders were combined in the proportions shown in Table 2. The resulting mixtures were placed in separate capsules made of carbon steel, and the capsules were evacuated under a vacuum of $1\times10^{-2}$ mmHg at 500° C. for one hour while heating and were sealed.

The evacuation may be carried out at room temperature. However, in order to promote the removal of moisture, heating is desirable. The heating temperature for this purpose is preferably 500° C., or lower. The thus packed capsules were sintered for one hour at 1050° C. at a pressure of 2000 atms using hot isostatic pressing.

The hot isostatic pressing should preferably be carried out under conditions that suppress as completely as possible the nickel diffusion from a ferritic stainless steel phase, i.e., a matrix phase to an austenitic stainless steel phase or to a duplex stainless steel phase, i.e., a dispersing phase, and the conditions should permit a sufficient degree of compacting and sintering to be carried out. Diffusion of nickel is preferably suppressed as much as possible, since the nickel diffusion to the matrix phase causes degradation in SCC resistance.

Suitable conditions for hot isostatic pressing should be determined depending on steel compositions and the mixing ratio of the constituent powders. The formation of an intermetallic compound should be avoided. Within the temperature range which satisfies the above, a lower temperature is desirable for achieving an easy operation. The upper limit is desirably about 1100° C. When the mixture is heated at a temperature higher than 1100° C., the better the shorter the holding time at the temperature is so that the diffusion of nickel is kept minimum.

The resulting sintered product was further subjected to heating at the indicated temperature for one hour in atmospheres. After that the product was subjected to hot forging to provide the following final dimensions: 30 mm thick×60 mm wide×L long.

The thus hot forged products in the form of plates were heated at the temperature indicated in Table 2 for one hour and were hot rolled to the final dimensions of 7 mm thick×60 mm wide. The hot rolled products were then subjected to final annealing at the temperature indicated in Table 2.

Test pieces were cut from the thus produced sintered stainless steel plates and they were subjected to a SCC resistance test, a Charpy impact test, and a room temperature tensile test.

The SCC resistance test was carried out using a test piece with a parallel portion 3 mm in diameter and 20 mm in length, which was placed in a boiling 42% $MgCl_2$ aqueous solution with a given degree of stress being applied to the test piece. The time until the test piece broke out was determined for each of the test pieces. The test results are summarized in Table 2.

As is apparent from the data shown in Table 2, the stainless steels of the present invention showed a fracture time longer than not only the conventional ones (Steels Nos. 15 and 16) but also the comparative austenitic sintered stainless steel (Steel No. 11). In particular, when the amount of ferritic phase was 70% or more, the test piece did not break under a stress of 40 kgf/mm$^2$ even after 1000 hours elapsed, exhibiting the same high resistance properties as a ferritic sintered stainless steel. The steel compositions of Steels Nos. 15 and 16 are shown in Table 3.

Figure 6:
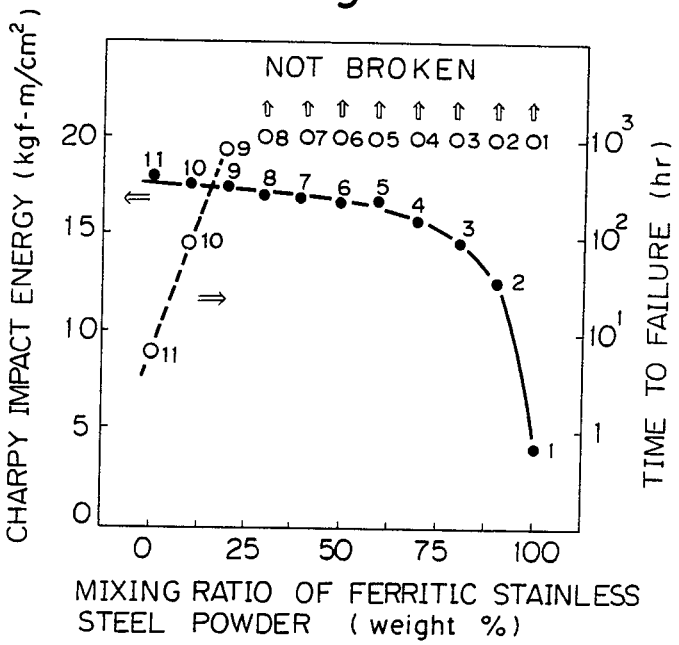
FIG. 6 is a graph showing Charpy impact test results.

FIG. 6 shows the time elapsed until the test piece broken when placed in a boiling 42% $MgCl_2$ solution under a stress of 35 kgf/mm$^2$, and the adsorption energy for the Charpy Impact Test plotted against the content of ferritic stainless steel powder. The reference numerals in the figure indicate the steel number of Table 2. The Charpy Impact test was carried out using JIS No. 4 test pieces which were 5 mm thick.

As is apparent from the data shown in FIG. 6, the amount of ferritic stainless steel powder is preferably 20% or more in view of improvement in the SCC resistance. On the other hand, in order to further improve toughness, the amount is preferably 80% or less. In addition, as shown in Table 2, when the amount of ferritic phase is 20%, the rupture time is 1000 hours or less at a stress of 40 kgf/mm$^2$. Therefore, the amount of ferrite is preferably 30% or more.

EXAMPLE 2

A rod of a duplex stainless steel comprising a ferritic phase as well as an austenitic phase was prepared using Steel Powders B and E of Table 1.

Steel Powder B and Steel Powder E both containing molybdemum were mixed at a ratio of 1:1, and the resulting mixture was packed into a steel capsule 100 mm in diameter and 300 mm long. While heating at 500° C., the capsule was evacuated to a vacuum of $1\times10^{-2}$ mmHg. After maintaining in vacuo for 3 hours, the capsule was sealed and was subjected to cold isostatic pressing at room temperature to make the density within the capsule uniform with less porosity.

Then, the capsule was heated to 1050° C. in an electric furnace and a rod 28 mm in diameter was formed through hot extrusion. Annealing was carried out on this rod at 930° C. for one hour. The preparation of test pieces and the test procedures were the same as in Example 1. The test results are summarized in FIG. 7 and in Table 2 (see Steel No. 12). Conventional Steels Nos. 15 and 16 were prepared through a conventional ingot making process.

Figure 7:
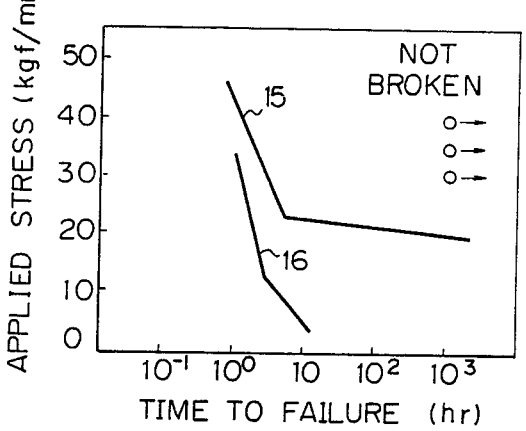
FIG. 7 is a graph showing SCC resistance test results.

As is apparent from FIG. 7, steel No. 16, which is representative of austenitic stainless steel, was broken within 2–3 hours. On the other hand, in the case of a duplex stainless steel (Steel No. 15), the test pieces were easily broken within 10 hours at an applied stress of 25 kgf/mm$^2$ or more. However, according to the present invention, as indicated by the symbol "O", at stress levels of 40, 35, and 30 kgf/mm$^2$, the test pieces were not broken even after 1000 hours elapsed. This is compatible with that of the conventional ferritic stainless steel, which is prepared through an ingot making process.

Figure 8:
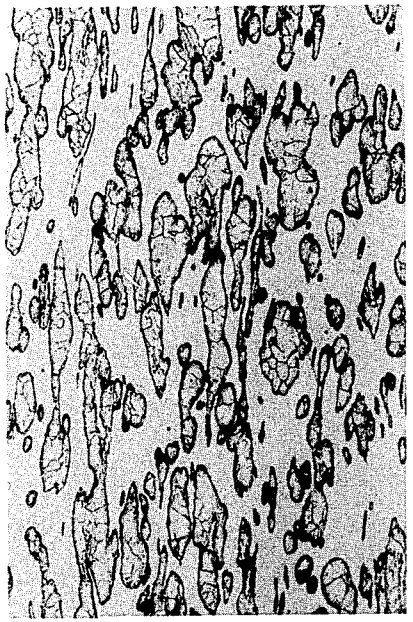
FIG. 8 is a microphotograph (×100) showing the typical metallurgical structure of the sintered stainless steel of the present invention.

FIG. 8 shows the microstructure of the sintered stainless steel corresponding to Steel No. 5 of Example 1. The magnification is $\times 100$. In the figure the white portion indicates a ferritic phase and dark portion indicates an austenitic phase. Around the austenitic grains there exists a grain boundary. That is, the proportion of ferritic phase and austenitic phase found in the starting powders at the time of mixing was well maintained in a sintered product.

Usually, a rolled plate of a duplex stainless steel prepared through a conventional ingot making process has a metallurgical structure in which an austenitic phase is extended in a ferritic matrix. Therefore, according to the present invention, the resulting metallurgical structures are quite different from each other. The size of this austenitic phase as a dispersing phase is very large. This is because the ferritic phase comes from a ferritic stainless steel powder and the austenitic phase comes from an austenitic stainless steel powder.

EXAMPLE 3

In this example, six types of stainless steel powder (−300 mesh) were used, the steel compositions of which are shown in Table 4. These powders were prepared in accordance with a conventional atomization process. Steel Powders G, H, and I were ferritic, and Steel Powders J and K were austenitic. Steel Powder L was of duplex stainless steel.

As in Example 1, these steel powders were mixed in the ratios shown in Table 5 and the resulting steel powder mixtures were packed into separate carbon steel capsules. The capsule was evacuated under vacuo of $1\times10^{-2}$ mmHg at 500° C. for one hour. The evacuation may be carried out at room temperature. The capsule is preferably heated so as to remove moisture from the powder mixture. For this purpose, the powder mixture may be heated to a temperature of 200°-500° C. The heating temperature should be determined after taking into consideration whether an intermetallic compound such as $\sigma$-phase etc. is formed, especially in the case of a steel which easily forms such an intermetallic compound. So long as the above requirements are met, a lower temperature is preferable.

It is herein to be noted that it is necessary to carry out the hot isostatic pressing under conditions enough to thoroughly suppress the nickel diffusion from an austenitic stainless steel powder or duplex stainless steel powder to a ferritic stainless steel powder, and also to achieve satisfactory compacting and sintering. In general, when the powder mixture is heated to a temperature higher than 1100° C., nickel diffuses so much resulting in a marked degradation in SCC resistance. After evacuation, nitrogen gas may be contained in the capsule. Then the capsule was worked into a sintered seamless steel pipe through a variety of manufacturing steps which are listed in Table 6.

Instead of cold isostatic pressing, hot isostatic pressing may be employed in order to carry out compacting and sintering simultaneously.

In order to determine the relationship between the heating temperature before hot working and the SCC resistance, Sintered Steel Samples Nos. 12, 21 and 22 of Table 5 were used, which were heated after completion of cold isostatic pressing for 40 minutes and then water quenched. The specimens were dipped into a boiling 42% $MgCl_2$ aqueous solution to determine the time until the specimens broke.

Figure 9:
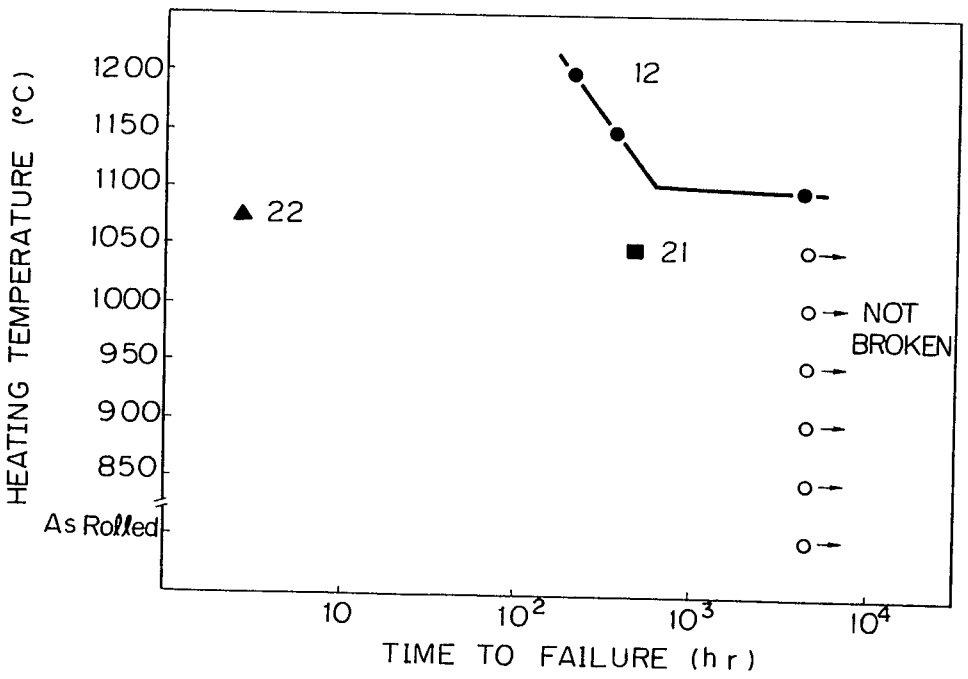
FIG. 9 is a graph showing the relationship between the SCC resistance properties and the heating temperature.

FIG. 9 graphically shows the test results. Solid black symbols in the graph indicate that the specimen broke.

As is apparent from FIG. 9, when the heating temperature is higher than 1100° C., the specimens are easily ruptured, because nickel diffusion remarkably increases at such a high temperature, causing degradation in the SCC resistance.

After shaping through cold isostatic pressing, the resulting capsule was heated at the indicated temperature for one hour and then was subjected to hot extrusion to produce a seamless sintered stainless steel pipe with an outer diameter of 60 mm and an inner diameter of 38 mm. Heating treatment may be applied, if necessary. Then, the carbon steel capsule was removed by means of pickling. The resulting pipe was further subjected to cold drawing to provide a sintered seamless pipe 22 mm in outer diameter and 15 mm in inner diameter. Finishing annealing and pickling were performed on the thus shaped seamless sintered stainless steel pipe.

Specimens for an SCC resistance test and tensile strength test were cut from the thus obtained pipe. These specimens were used in the same manner as in Example 1 to determine the SCC resistance, and mechanical properties. Test results are summarized in Table 5.

In addition, specimens for a "Double U-shaped Bend" test were also cut from the pipe. Two test pieces 2 mm thick, 10 mm wide, and 75 mm long were placed on one another and the two test pieces were bent into the shape of a "U". The thus prepared test pieces were dipped into a high temperature solution containing 1000 ppm $Cl^-$ ions to determine the occurrence of SCC. The test results are also summarized in Table 5.

A flatness test was also carried out for as-hot-worked pipes. Test results are also summarized in Table 5, from which it is noted that the sintered seamless steel pipe of the present invention exhibited improved flattening properties in comparison with those of sintered seamless steel pipe prepared from a duplex stainless steel powder.

Although the invention has been described with respect to preferred embodiments it is to be understood that variations and modifications may be employed without departing from the concept of the invention as defined in the following claims.

TABLE 1

| Steel | C | N | Si | Mn | P | S | Cu | Ni | Cr | Mo | O | Remarks |
|---|---|---|---|---|---|---|---|---|---|---|---|---|
| A | 0.006 | 0.010 | 0.48 | 0.52 | 0.013 | 0.001 | 0.02 | 0.03 | 19.5 | — | 0.003 | Ferritic Stainless Steel |
| B | 0.003 | 0.009 | 0.50 | 0.50 | 0.013 | 0.001 | 0.01 | 0.03 | 19.3 | 2.03 | 0.004 | Ferritic Stainless Steel |
| C | 0.004 | 0.008 | 0.51 | 0.50 | 0.012 | 0.001 | 0.02 | 0.02 | 25.8 | 1.02 | 0.003 | Ferritic Stainless Steel |
| D | 0.020 | 0.069 | 0.48 | 1.51 | 0.011 | 0.001 | 0.05 | 10.0 | 18.4 | — | 0.006 | Austenitic Stainless Steel |

TABLE 1-continued

| Steel | C | N | Si | Mn | P | S | Cu | Ni | Cr | Mo | O | Remarks |
|---|---|---|---|---|---|---|---|---|---|---|---|---|
| E | 0.018 | 0.058 | 0.46 | 1.68 | 0.013 | 0.001 | 0.03 | 13.8 | 16.7 | 2.43 | 0.004 | Austenitic Stainless Steel |
| F | 0.020 | 0.128 | 0.35 | 1.69 | 0.008 | 0.001 | 0.08 | 5.4 | 22.4 | 2.88 | 0.003 | Duplex Stainless Steel |

TABLE 3

| | C | N | Si | Mn | Cr | Mo | Ni | |
|---|---|---|---|---|---|---|---|---|
| Duplex Stainless Steel | 0.015 | 0.138 | 0.40 | 1.57 | 21.90 | 2.98 | 5.50 | AISI S31803 |
| Austenitic Stainless Steel | 0.020 | 0.018 | 0.40 | 1.53 | 18.92 | <0.1 | 11.20 | AISI 304 |

TABLE 2

| Steel | Steel Powder Proportion (wt %) | | | | | | Heating Temp. before Working | Annealing Temp. | Mechanical Properties at Room Temp. | | | | SCC Resistance (Rupture Time, hr) Applied Stress (kgf/mm²) | | | |
|---|---|---|---|---|---|---|---|---|---|---|---|---|---|---|---|---|
| | | | | | | | | | Yield Strength (kgf/mm²) | Tensile Strength (kgf/mm²) | Elongation (%) | Drawing (%) | | | | |
| No. | A | B | C | D | E | F | (°C.) | (°C.) | | | | | 40 | 35 | 30 | Remarks |
| 1 | 100 | — | — | — | — | — | 1050 | 930 | 25.0 | 45.1 | 40.0 | 60 | 1000≦ | 1000≦ | 1000≦ | Comparative |
| 2 | 90 | — | — | 10 | — | — | " | " | 29.3 | 49.3 | 42.7 | 60 | " | " | " | Present |
| 3 | 80 | — | — | 20 | — | — | " | " | 38.5 | 58.1 | 42.0 | 60 | " | " | " | invention |
| 4 | 70 | — | — | 30 | — | — | " | " | 42.3 | 63.3 | 43.3 | 60 | " | " | " | |
| 5 | 60 | — | — | 40 | — | — | " | " | 46.2 | 66.7 | 44.0 | 60 | " | " | " | |
| 6 | 50 | — | — | 50 | — | — | " | " | 46.8 | 75.3 | 43.8 | 60 | " | " | " | |
| 7 | 40 | — | — | 60 | — | — | " | " | 47.2 | 78.2 | 42.9 | 60 | " | " | " | |
| 8 | 30 | — | — | 70 | — | — | " | " | 46.5 | 78.6 | 41.0 | 60 | " | " | " | |
| 9 | 20 | — | — | 80 | — | — | " | " | 46.3 | 79.0 | 43.0 | 60 | 250 | " | " | |
| 10 | 10 | — | — | 90 | — | — | " | " | 45.7 | 78.0 | 42.8 | 60 | 70 | 90 | 150 | |
| 11 | — | — | — | 100 | — | — | " | 1050 | 45.3 | 78.2 | 43.2 | 60 | 4 | 8 | 15 | Comparative |
| 12 | — | 50 | — | — | 50 | — | " | 930 | 46.2 | 67.0 | 42.8 | 60 | 1000≦ | 1000≦ | 1000≦ | Present |
| 13 | — | — | 50 | — | — | 50 | 1030 | 1030 | 46.5 | 69.9 | 45.0 | 60 | " | " | " | Invention |
| 14 | — | — | 50 | — | 25 | 25 | 1030 | 1030 | 45.3 | 65.7 | 43.3 | 58 | " | " | " | |
| 15* | Duplex stainless steel** | | | | | | | 1050 | 61.5 | 79.6 | 35.3 | 73 | 1 | 5 | 6 | Conventional |
| 16* | Austenitic stainless steel** | | | | | | | 1050 | 23.9 | 56.6 | 68.6 | 72 | 0.5 | 2 | 3 | |

(Note)
*The steel compositions of Steel Nos. 15 and 16 are shown in Table 3.
**These steels we prepared using a conventional ingot making process.

TABLE 4

| Steel | C | N | Si | Mn | P | S | Cu | Ni | Cr | Mo | O | Remarks |
|---|---|---|---|---|---|---|---|---|---|---|---|---|
| G | 0.006 | 0.010 | 0.48 | 0.52 | 0.013 | 0.001 | 0.02 | 0.03 | 19.5 | 0.62 | 0.003 | Ferritic Stainless Steel |
| H | 0.003 | 0.009 | 0.50 | 0.50 | 0.013 | 0.001 | 0.01 | 0.03 | 19.3 | 2.03 | 0.004 | Ferritic Stainless Steel |
| I | 0.004 | 0.008 | 0.51 | 0.50 | 0.012 | 0.001 | 0.02 | 0.02 | 25.8 | 1.02 | 0.003 | Ferritic Stainless Steel |
| J | 0.020 | 0.069 | 0.48 | 1.51 | 0.011 | 0.001 | 0.05 | 10.0 | 18.4 | 0.59 | 0.006 | Austenitic Stainless Steel |
| K | 0.018 | 0.058 | 0.46 | 1.68 | 0.013 | 0.001 | 0.03 | 13.8 | 16.7 | 2.43 | 0.004 | Austenitic Stainless Steel |
| L | 0.020 | 0.128 | 0.35 | 1.69 | 0.008 | 0.001 | 0.08 | 5.4 | 22.4 | 2.88 | 0.003 | Duplex Stainless Steel |

TABLE 5

| Steel | Steel Powder Proportion (wt %) | | | | | | Process Number | Heating Temp. before | Annealing Temp. | Flattening test |
|---|---|---|---|---|---|---|---|---|---|---|
| No. | G | H | I | J | K | L | (See Table 6) | Working (°C.) | (°C.) | (180° Bending) |
| 1 | 100 | — | — | — | — | — | IV | 1030 | 920 | No cracking |
| 2 | 90 | — | — | 10 | — | — | IV | " | " | " |
| 3 | 80 | — | — | 20 | — | — | " | " | " | " |
| 4 | 70 | — | — | 30 | — | — | " | " | " | " |
| 5 | 60 | — | — | 40 | — | — | " | " | " | " |
| 6 | 50 | — | — | 50 | — | — | " | " | " | " |
| 7 | 40 | — | — | 60 | — | — | " | " | " | " |
| 8 | 30 | — | — | 70 | — | — | " | " | " | " |
| 9 | 20 | — | — | 80 | — | — | " | " | " | " |

TABLE 5-continued

| | | | | | | | | | | |
|---|---|---|---|---|---|---|---|---|---|---|
| 10 | 10 | — | — | 90 | — | — | " | " | " | " |
| 11 | — | — | — | 100 | — | — | IV | 1050 | 1050 | " |
| 12 | — | 50 | — | — | 50 | — | III | 1050 | — | " |
| 13 | — | 50 | — | — | 50 | — | IV | " | 1050 | " |
| 14 | — | 50 | — | — | 50 | — | V | " | — | " |
| 15 | — | 50 | — | — | 50 | — | VI | " | 1050 | " |
| 16** | — | 50 | — | — | 50 | — | VII | " | " | " |
| 17** | — | 50 | — | — | 50 | | VIII | " | " | " |
| 18 | — | — | 50 | — | — | 50 | VI | " | " | " |
| 19 | — | — | 50 | — | 25 | 25 | VI | " | " | " |
| 20 | — | — | — | — | — | 100 | VI | " | " | " |
| 21* | Duplex stainless steel | | | | | | | " | " | " |
| 22* | Austenitic stainless steel | | | | | | | " | " | " |

| Steel No. | Mechanical Properties at Room Temp. Yield Strength (kgf/mm²) | Tensile Strength (kgf/mm²) | Elongation (%) | Drawing (%) | SCC Resistance (Rupture time, hr) Applied Stress (kgf/mm²) 40 | 35 | 30 | SCC Resistance in 1000 ppm Cl solution at 200° C. for 500 hr. | Remarks |
|---|---|---|---|---|---|---|---|---|---|
| 1 | 25.6 | 45.7 | 41.2 | 59 | 1000≦ | 1000≦ | 1000≦ | No cracking | Comparative |
| 2 | 30.5 | 49.7 | 42.6 | 58 | " | " | " | " | |
| 3 | 38.7 | 58.6 | 42.5 | 60 | " | " | " | " | |
| 4 | 43.1 | 63.8 | 43.8 | 59 | " | " | " | " | |
| 5 | 46.8 | 66.9 | 44.5 | 60 | " | " | " | " | Present |
| 6 | 47.3 | 75.9 | 43.8 | 59 | " | " | " | " | Invention |
| 7 | 47.8 | 78.5 | 43.0 | 58 | " | " | " | " | |
| 8 | 47.0 | 78.9 | 41.3 | 60 | " | " | " | " | |
| 9 | 46.8 | 79.2 | 42.5 | 60 | 250 | 920 | " | " | |
| 10 | 46.3 | 78.8 | 43.0 | 59 | 70 | 90 | 150 | Micro cracking | |
| 11 | 45.8 | 79.3 | 43.6 | 59 | 4 | 8 | 15 | Broken | Comparative |
| 12 | 68.3 | 38.5 | 42.3 | 68 | 1000≦ | 1000≦ | 1000≦ | No cracking | |
| 13 | 62.9 | 38.0 | 44.0 | 69 | " | " | " | " | |
| 14 | 68.6 | 38.8 | 43.9 | 69 | " | " | " | " | |
| 15 | 63.0 | 38.1 | 46.0 | 70 | " | " | " | " | Present |
| 16** | 63.5 | 38.3 | 45.6 | 69 | " | " | " | " | Invention |
| 17** | 63.6 | 39.0 | 45.4 | 70 | " | " | " | " | |
| 18 | 76.3 | 53.8 | 43.0 | 67 | " | " | " | " | |
| 19 | 72.3 | 52.9 | 41.5 | 68 | " | " | " | " | |
| 20 | 88.0 | 60.3 | 28.0 | 69 | 1 | 7 | 10 | Broken | Conven- |
| 21* | 61.5 | 79.6 | 35.3 | 73 | 1 | 5 | 6 | " | tional |
| 22* | 23.9 | 56.6 | 68.6 | 72 | 0.5 | 0.5 | 3 | " | |

(Note)
*The steel compositions of Steel Nos. 21 and 22 are shown in Table 3.
**The tensile test for Steel Nos. 16 and 17 were carried out using an arc-shaped test piece.

TABLE 6

| Process Number | Process |
|---|---|
| I: | Packing into Capsule + Degassing |
| II: | Process-I + Containment of $N_2$-gas |
| III: | Process-I + C.I.P. + Hot Extrusion |
| IV: | Process-III + Annealing |
| V: | Process-II + C.I.P. + Hot Extrusion |
| VI: | Process-V + Annealing |
| VII: | Process-IV + Cold Drawing + Annealing |
| VIII: | Process-VI + Cold Drawing + Annealing |

What is claimed is:

1. A sintered stainless steel exhibiting improved resistance to stress corrosion cracking, which comprises a matrix phase and discrete islands of a dispersing phase, the metallurgical structures of which are different from each other, the matrix phase comprising a substantially single ferritic structure derived from a ferritic stainless steel powder, and the dispersing phase comprising a structure selected from the group consisting of an austenitic structure, an austenitic+ferritic dual phase structure, an austenitic+martensitic dual phase structure, and an austenitic+ferritic+martensitic triple phase structure, which are derived respectively from an austenitic stainless steel powder, an austenitic+ferritic duplex stainless steel powder, an austenitic+martensitic duplex stainless steel powder and a triple phase stainless steel powder.

2. A sintered stainless steel as defined in claim 1, in which the dispersing phase comprises an austenitic structure.

3. A sintered stainless steel as defined in claim 1, in which the dispersing phase comprises an austenitic+ferritic or austenitic+martensitic dual phase structure.

4. A sintered stainless steel as defined in claim 1, in which the dispersing phase comprises an austenitic+ferritic+ +martensitic triple phase structure.

5. A sintered stainless steel as defined in claim 1, in which the matrix phase comprises a ferritic structure containing a slight amount of martensite.

6. A sintered stainless steel as defined in claim 1, in which on an average the nickel content of the matrix phase is 1% or less.

7. A sintered stainless steel as defined in claim 1, in which the metallurgical structure comprises 20–80% by weight of a ferritic phase derived from a ferritic stainless steel powder.

8. A sintered stainless steel as defined in claim 1, in which the matrix phase contains a small amount of molybdenum.

9. A sintered stainless steel as defined in claim 1, in which the matrix phase contains 0.5% or more of molybdenum.

10. A sintered stainless steel as defined in claim 1, in which the dispersing phase comprises an austenitic structure and the matrix phase contains a small amount of molybdenum.

11. A sintered stainless steel as defined in claim 1, in which the dispersing phase comprises an austenitic structure and the matrix phase contains 0.5% or more of molybdenum.

12. A process for producing a sintered stainless steel exhibiting improved resistance to stress corrosion cracking, which comprises a matrix phase and discrete islands of a dispersing phase, the metallurgical structures of which are different from each other, comprising the steps of mixing a ferritic stainless steel powder with a powder selected from the group consisting of an austenitic stainless steel powder, an austenitic+ferritic duplex stainless steel powder, an austenitic+martensitic duplex stainless steel powder, and an austenitic+ferritic+martensitic triple phase stainless steel powder, and compacting and sintering the resulting powder mixture.

13. A process for producing a sintered stainless steel as defined in claim 12, in which the compacting and sintering are simultaneously carried out using hot isostatic pressing.

14. A process for producing a sintered stainless steel as defined in claim 12, in which the compacting is carried out using cold isostatic pressing, and after compacting the sintering is carried out.

15. A process for producing a sintered stainless steel as defined in claim 12, in which the sintering is carried out at a temperature of 1100° C. or lower.

16. A sintered seamless stainless steel pipe exhibiting improved resistance to stress corrosion cracking which comprises a matrix phase and discrete islands of a dispersing phase, the metallurgical structures of which are different from each other, the matrix phase comprising a substantially single ferritic structure derived from a ferritic stainless steel powder, and the dispersing phase comprising a structure selected from the group consisting of an austenitic structure, an austenitic+ferritic dual phase structure, an austenitic+martensitic dual phase structure, and an austenitic+ferritic+martensitic triple phase structure, which are derived respectively from an austenitic stainless steel powder, an austenitic+ferritic duplex stainless steel powder, an austenitic+martensitic duplex stainless steel powder and an austenitic+ferritic+martensitic triple phase stainless steel powder.

17. A sintered seamless stainless steel pipe as defined in claim 16, in which the dispersing phase comprises an austenitic structure.

18. A sintered seamless stainless steel pipe as defined in claim 16, in which the dispersing phase comprises an austenitic+ferritic or austenitic+martensitic dual phase structure.

19. A sintered seamless stainless steel pipe as defined in claim 16, in which the dispersing phase comprises an austenitic+ferritic+artensitic triple phase structure.

20. A sintered seamless stainless steel pipe as defined in claim 16, in which the matrix phase comprises a ferritic structure containing a slight amount of martensite.

21. A sintered seamless stainless steel pipe as defined in claim 16, in which on an average the nickel content of the matrix phase is 1% or less.

22. A sintered seamless stainless steel pipe as defined in claim 16, in which the metallurgical structure comprises 20–80% by weight of a ferritic phase derived from a ferritic stainless steel powder.

23. A sintered seamless stainless steel pipe as defined in claim 16, in which the matrix phase contains a small amount of molybdenum.

24. A sintered seamless stainless steel pipe as defined in claim 16, in which the matrix phase contains 0.5% or more of molybdenum.

* * * * *